United States Patent [19]

Bohl et al.

[11] Patent Number: 4,896,482

[45] Date of Patent: Jan. 30, 1990

[54] BUNDLING MACHINE AND A METHOD OF BUNDLING MATERIAL

[76] Inventors: Michael Bohl, Schillerplatz 8; Karlheinz Brieden, Furweg 5, both of 5609 Huckeswagen, Fed. Rep. of Germany

[21] Appl. No.: 114,301

[22] Filed: Oct. 28, 1987

[51] Int. Cl.[4] ..... B65B 13/24

[52] U.S. Cl. ..... 53/588; 53/589; 100/33 PB

[58] Field of Search ..... 53/588, 589, 582; 100/27, 33 PB

[56] References Cited

U.S. PATENT DOCUMENTS 3,003,297 10/1961 Broadhead ..... 100/27

4,776,905 10/1988 Cheung ..... 100/33 PB

*Primary Examiner*—John Sipos

*Attorney, Agent, or Firm*—Wood, Herron & Evans

[57] ABSTRACT

A bundling machine comprising a bundling material supply roll moving along a circular path and a gripping device for engaging and cutting the bundling material, such gripping device having two beams able to be actuated to clamp and cut the bundling material, and of which one beam is able to be swung in relation to the other beam, such beams being guided by a carrier for performing a movement into and out of the bundling plane and a carriage is able to be moved in direction normal to the direction of motion of the carrier, one such beam being pivotally mounted on the carriage.

7 Claims, 6 Drawing Sheets

BUNDLING MACHINE AND A METHOD OF BUNDLING MATERIAL

The German unexamined specification 3,236,438 describes a bundling machine which comprises a ring rotating about a central axis with a supply roll, whose path of rotation determines the bundling plane, in which the material to be bundled is placed. There is furthermore a gripper device which is able to be moved from the opposite side of the ring so as to be parallel to the central axis, is mounted on a carrier on the machine and moves through the ring as far as the bundling plane The gripping device comprises a horizontally aligned beam, on which a pivoting beam is pivoted, which for its part is made up of a clamping member and a knife. Such a design suffers from the disadvantage that the gripping device has to move along a relatively long path and this makes such a bundling machine less economic to use. Furthermore, this construction means that the machine has a comparatively great length and the floor space requirement is large. The clamping member with the knife pivots into the engagement position in relation to the material to be cut in the bundling machine so that awkward materials will not be neatly cut.

The object of the present invention is to devise a bundling machine of the type in question with a compact structure and able to be simply manufactured. Furthermore the machine is intended to produce neat cuts in the material being bundled. Another aim of the invention is to provide a method which enables bundles of material to be economically produced.

A bundling machine constructed in accordance with the present invention has enhanced utility. Unlike known constructions it is able to be manufactured in a compact form. In the neutral position of the bundling machine the gripping device is so positioned in a setting retracted from the bundling plane that the end of the bundling material coming from the supply roll runs along a path with a certain length obliquely to the bundling plane. If the material to be bundled is now placed thereon and the drive turned on then after training the bundling material at least once around the material to be bundled, the end section of the bundling material will have the gripping device placed around it and be held in place so that thereafter the gripping device may open without any risk of the first turn trained around the material slipping off it again. Thereafter further turns may be trained around the material. Prior to training the last turn around the material the carrier moves the gripping device into the bundling plane so that the material is trained around the one beam. It is now possible for the drive to be halted. Thereafter the other beam is moved into a position which is parallel to the other beam around which material has already been trained. Owing to its pivoting connection with the carriage, this beam then moves in parallelism to itself towards the beam with the bundling material trained round it, a previously executed clamping action ensuring a neat cutting of the bundling material. The end section of the bundling material leading to the supply roll is still held while the other end section is released for application to the material to be bundled. After this the carrier with the gripping device moves back towards the neutral or starting position so that the next bundling operation may be performed. While the one beam is indirectly supported on the carrier, the other beam is securely fixed to the carrier. For pivoting the swinging beam there is a pivoting member, which may for example be in the form of a pneumatically actuated cylinder actuator. However steps are taken to ensure that at all times the pivoting of the beam takes place only at this stage and not beforehand. It is only then that motion in parallelism takes place. This is ensured inasfar as there is a stop which limits the pivoting motion.

Further operation by the pivoting member then exclusively leads to a displacement of the carriage oppositely to its biased setting. This means that the pivoting member and the element producing the bias operate in opposite directions. There are constructional advantages inasfar as the stop is provided on the carrier. Fine adjustment may for example be ensured by the use of a stop screw so that it is always possible to ensure that the pivoted and the stationary beams are precisely parallel to each other and this leads to neat cuts. Since the beam carries a spring-loaded clamping member and a cutting knife adjacent thereto it is possible for the operations of clamping and cutting to be precisely matched to suit each other. During the movement of the carriage separation then takes place inasfar as a smooth cut is produced. Different bundling materials may therefore be utilized without neat cutting of the material being impaired. A particularly space-saving design which has advantages as regards the control system to be used therefor is one in which the carrier is pivoted at its end opposite to the beams. This leads to a double pivoting action of the one beam. The space available within the machine is furthermore optimally utililized if the pivot axis of the carrier is parallel to the plane of bundling and near thereto. The arrangement of the carrier as well for holding the pivoting member leads to the compact constructional form. This design is also advantageous as regards control systems because of the small distances moved by the pivoting member. In order to ensure that the start and the end of the bundling material do not project beyond the bundling material, there are means for applying the same to the material to be bundled. In the case of certain materials it is best for these means to be designed for pneumatic operation. They may thus with advantage be designed in the form of air nozzles, which systematically bring the respective end sections into the prescribed setting. This design is particularly suitable if the bundling material is a relatively thin plastic film. The latter has a certain elastic stretch effect. It is for example possible to use plastic stretch film with a thickness of 17 to 35 microns without any trouble. It is however also possible for the means to be in the form of mechanically operating components which bring the respective end sections into the setting for application. It would also be possible to have hot air nozzles to cause an incipient fusion of the respective parts of the bundling material so that the end sections may be adhered together in a way supplementing their tendency to stick together without fusing.

The present method of bundling material is particularly advantageous since the material is bundled very rapidly.

One preferred form of bundling machine constructed in accordance with the present invention will now be described with reference to FIGS. 1 through 13.

Figure 1:
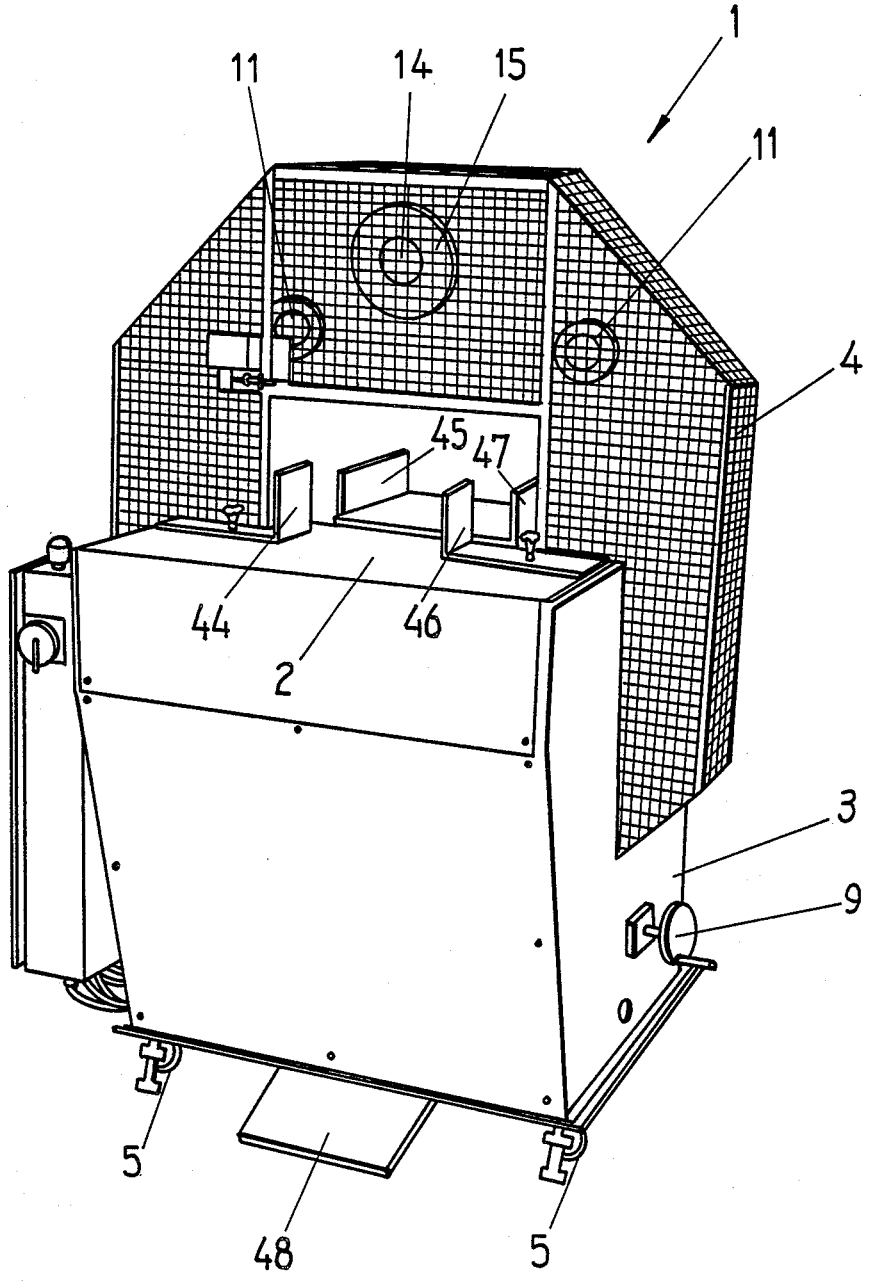
FIG. 1 is a perspective view of a machine designed in accordance with the present invention.

The bundling machine 1 possesses a lower part 3 forming a work table 2 and an upper part 4 extending in the bundling plane. In the example under consideration the lower part 3 is carried by castors 5, this making it possible for the bundling machine to be moved between different places where it is to be used.

A slide 7 provided with an opening 6 runs parallel to the bundling plane in the lower part 3 and the upper part 4. This slide may be adjusted in height by means of a lead screw drive 8 which is not illustrated in any detail. The lead screw drive may be operated from the outside by a handwheel 9.

The slide is the element carrying a drive which is not shown. By means of the drive it possible for a drive wheel 10 to be caused to turn, which supports a ring 12 by cooperating with a further idler wheel 11 mounted on the slide 7.

On the side turned away from the slide 7 the ring 12 carries a boom 13 with a plug pin 14 to receive a supply roll 15 of bundling material. In the present working example this material is in the form of a relatively thin plastic film. The pin 14 extends in a parallel manner to the central axis of the ring 12. The plane of rotation of the supply roll 15 is thus the bundling plane. The bundling material passes from the supply roll to the draw-off rolls 12' having an adjustable braking effect. Both the draw-off rolls 12' and also the supply roll 15 may be adjusted in regard to their braking effect.

Two guide rails 17 running parallel to the slide 7 are arranged on a foot plate 16 of the lower part 3. The rails accordingly extend parallel to the bundling plane. The guide rails 17 mount a support plate 18, from whose center a support 19 extends. At the upper end the support 19 has a pivot shaft 20 passing through it, which extends through an arm 22 extending at a right angle from a carrier 21. In the neutral position of the bundling machine the longitudinal axis of the carrier 21 makes an acute angle with the bundling plane. However, it may be moved into a setting in which it is parallel to the bundling plane. The operating means for this is a pneumatically operated cylinder actuator 23, which at one end is pivoted on the foot plate 16 and at its other end is pivoted to a boom 24 on the carrier 21. The latter extends towards the other side of the carrier 21 in relation to the arm 22.

A beam 25 is secured to the upper end of the carrier 21 so that the beam extends towards the bundling plane. The amount it projects in relation to the carrier is in this respect larger than the breadth of the bundling material.

The upper part of the carrier 21 is provided with two lateral guide rails 26, which accept a carriage 27 between them. The carriage 27 is provided with a joint pin 28 extending through the carrier 21 and a further beam 29 is arranged to pivot about this pin 28. Using a pivoting member 30 it is possible for this beam 29 to be swung into a position in which it is parallel to the other beam 25. This pivoting motion is limited by a rear stop 31 on the carrier 21. This stop 31 has an adjustable stop screw 32. The pivoting member 30 is a pneumatically operated cylinder actuator whose cylinder is jointed to a support 33 on the boom 24. The respective point of pivoting is indicated at 34. On the other hand the piston rod engages a pivot pin 35 of the beam 29.

A tension spring 36 has one end attached to a pin 37 on the carrier 21 and its other end on a fixed pin on the carriage 27. The latter is thus biased into a setting remote from the other beam 25. The tension spring 36 accordingly has an effect which is opposite to the outward motion of the pivoting member 30.

In the setting of the pivoting beam 29 which is parallel to the stationary beam 25 a clamping member 40, biased by two compression springs 39 in an outward direction, engages the lower side of the beam 25. There is a knife 41 adjacent to the clamping member 40. This knife is fixedly secured to the beam 29. If the carrier 27 is displaced by the tension spring 36 the clamping member 40 will project past the upper edge of the knife 41. The cutting edge thereof may be toothed in any suitable manner. The beam secured to the carrier has an entry groove 42 for the knife 41 at the same level as the latter.

Figure 2:
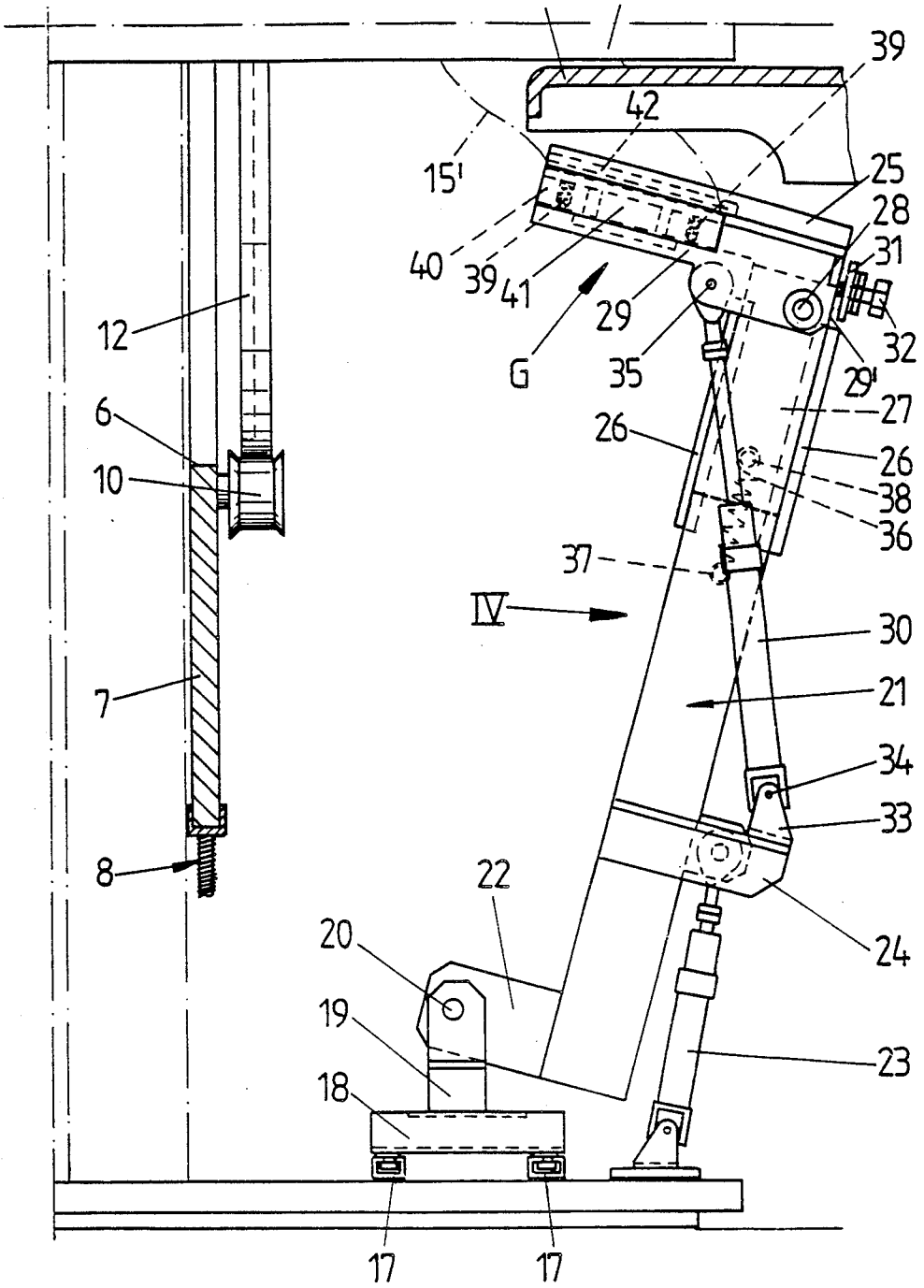
FIG. 2 shows a part of the machine adjacent to the ring bearing the supply roll with a gripping device placed in front of it held by a pivoting carrier, the gripping device being placed clear of the bundling plane and being closed when gripping the end section of the bundling material.
Figure 4:
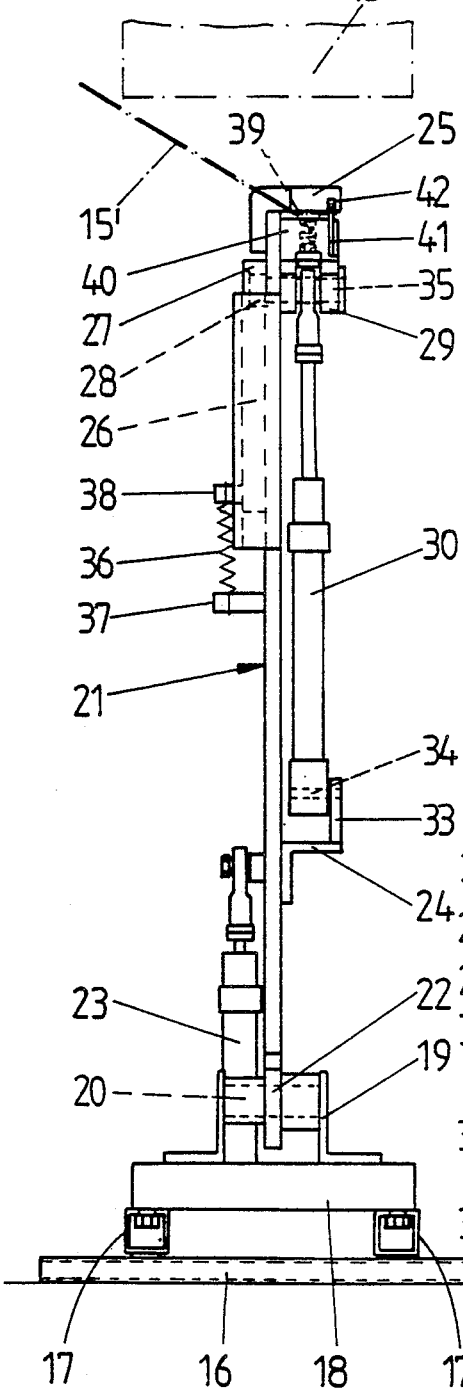
FIG. 4 is a view looking in the direction of the arrow IV in FIG. 2.
Figure 6:
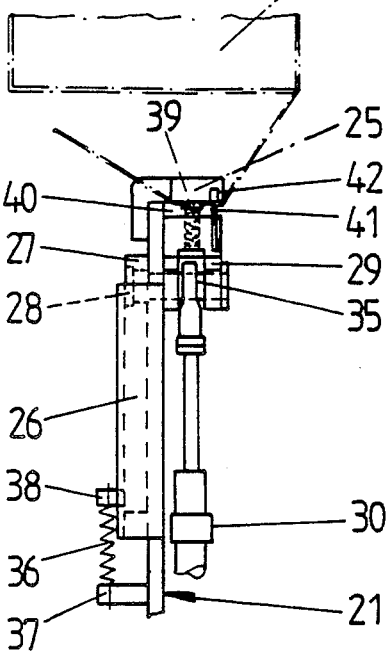
FIG. 6 is a view similar to that of FIG. 5 after the beam has been moved by the pivoting member into the abutted position only with a clamping action on the bundling material.
Figure 5:
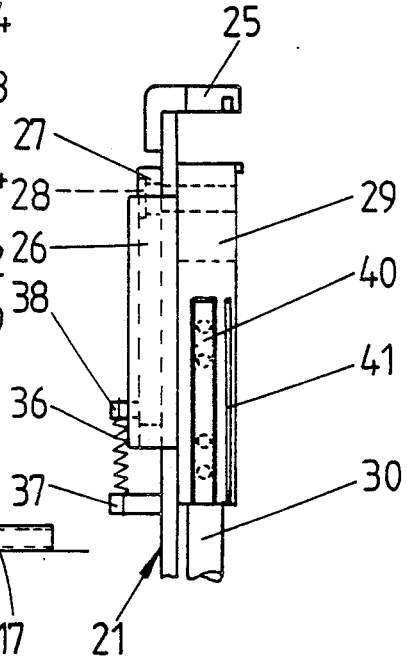
FIG. 5 is a view corresponding to FIG. 4 of the upper part of the carrier with the gripping device in the opened condition.
Figure 9:
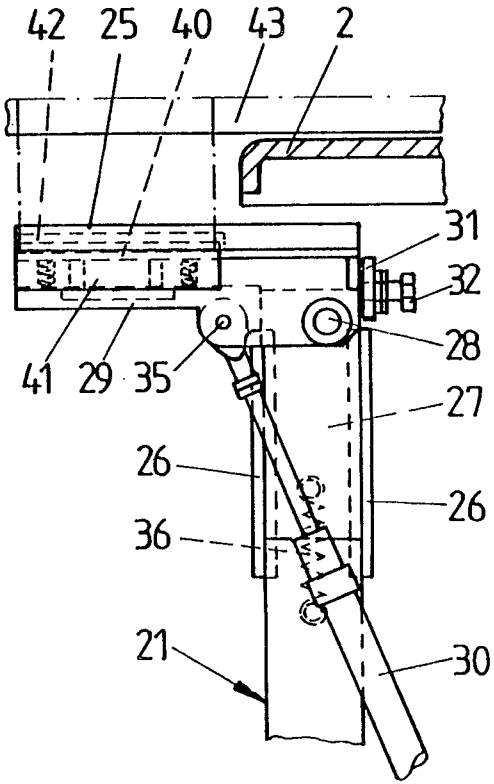
FIG. 9 is a view similar to that of FIG. 8, cutting having taken place owing to subsequent displacement of the carriage towards the beam on the carrier side, the position of the gripping device being like that of FIG. 2 with the difference that the gripping device is still in the bundling plane.
Figure 8:
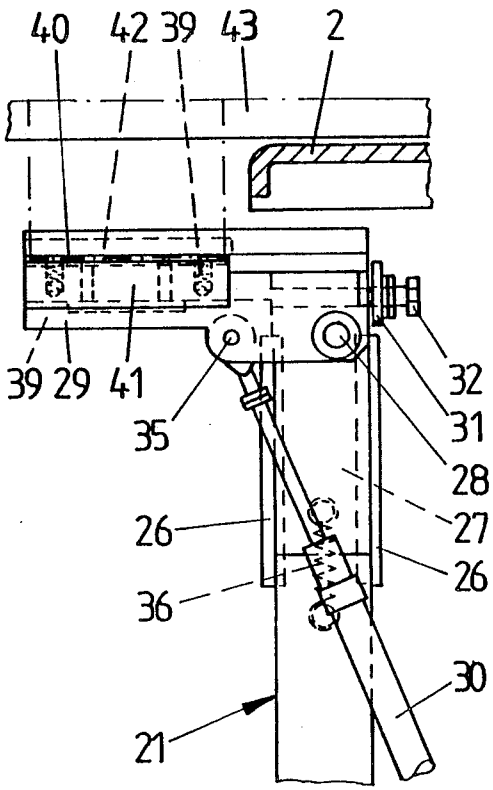
FIG. 8 is a view similar to FIG. 7 with the beam in the abutted setting so as to be comparable with the position shown in FIG. 6.
Figure 10:
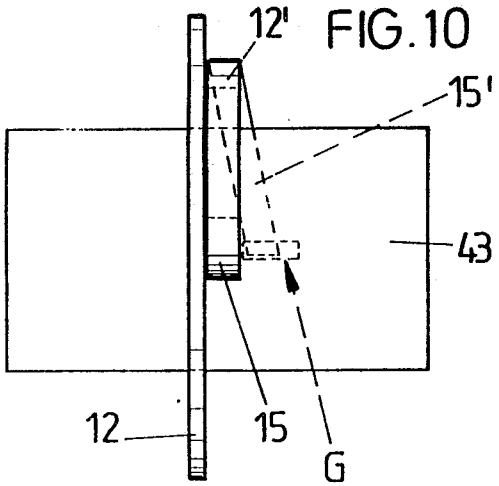

The manner of operation is as follows:

In the neutral position illustrated in FIGS. 2 and 10 of the bundling machine 1, the carrier 21 is so pivoted that its gripping device G is in front of the bundling plane. The end section 15' of the bundling material is engaged by the gripping member 40 in this position. FIG. 4 shows that the knife then extends into the entry groove 42 of the beam 25. Now a piece of material 43 to be bundled is placed in position, which may be made up of a single item or of a number of items. In the present working example it is a question of a parcel-like part. The material 43 to be bundled is so placed on the machine that the zone thereof to be tied is aligned with the bundling plane. Lateral sheet metal stops 44, 45, 46 and 47 then serve to locate the material 43 to be bundled in the desired position.

Figure 3:
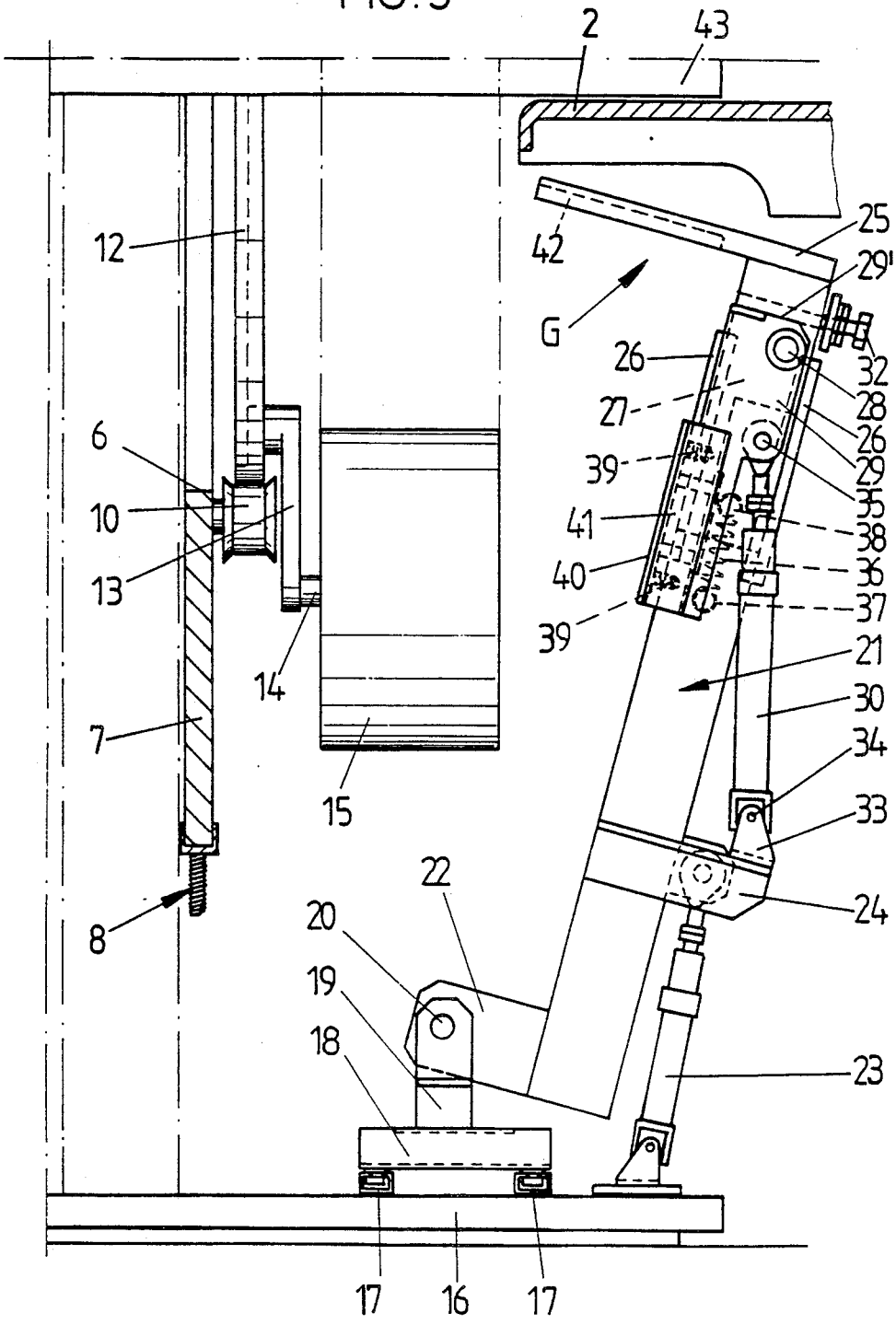
FIG. 3 is a view on the same lines as FIG. 2 in which the gripping device has opened after initial turning of the ring.
Figure 11:
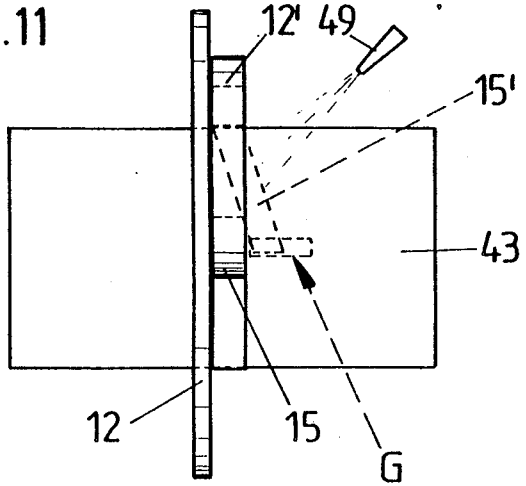
FIGS. 10 through 13 are a diagrammatic view from above to show the various functional positions during the bundling operation.

A foot switch 48 may now be operated to initiate the bundling operation. After the material to be bundled has been completely wrapped, the obliquely extending end section 15' is tucked in so that the bundling material is well secured on the material 43 to be bundled. By way of inductively functioning switches sensing the position of the ring 12 the pivoting member 30 receives a command to swing the beam 29 into the open position for the purpose of releasing the end section 15'. The swinging motion of the beam 29 is ended after about 90°. Prior to the start of the swinging displacement the tension spring 36 however moves the carriage 27 into the retraction position, see FIG. 3. Further wrapping of bundling material around the material to be bundled now takes place. After the opening of the gripping device an air nozzle 49 mounted in the interior of the machine is operated briefly, whose air jet moves the end section 15' of the bundling material towards the bundling plane and applied it to the abutment surface of the material to be bundled 43, see FIG. 11, so that on training further bundling material around the material to be bundled the end section 15' is securely covered over.

Figure 7:
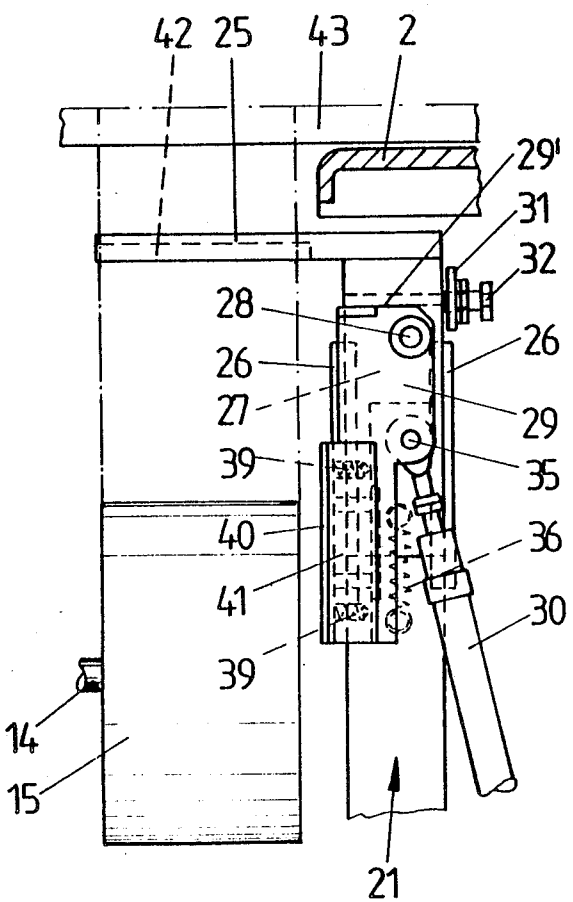
FIG. 7 is a lateral view of the gripping device after being swung into the bundling plane, the beam mounted on the carriage having assumed its open setting so that it is swung about 90° in a downward direction.
Figure 13:
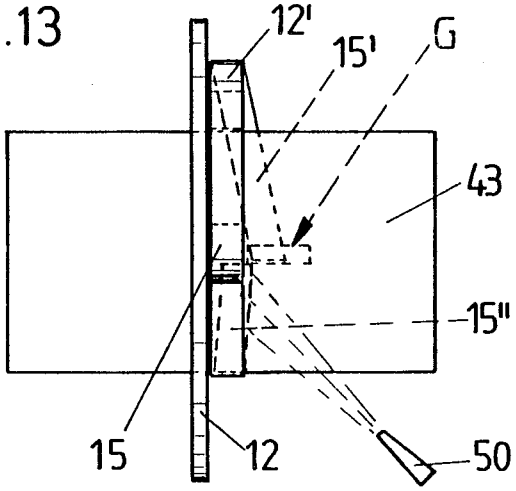
Figure 12:
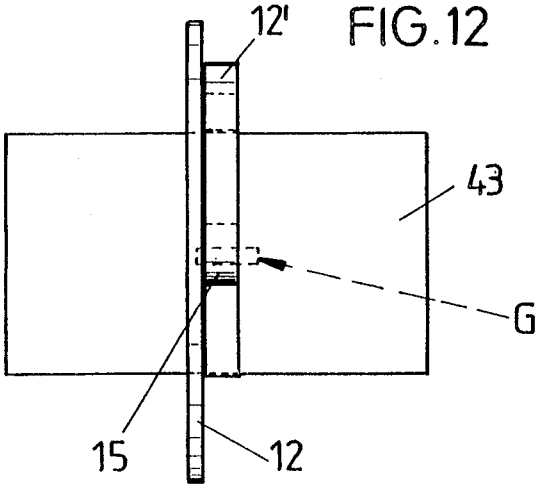

After a preset number of turns of bundling material have been applied, a pulse is supplied to the cylinder actuator 23 in order to shift the carrier 21 into the position parallel to the bundling plane, the beam 25 moving into the bundling plane, see the position marked in FIGS. 7 and 12. Accordingly the bundling material is moved under the beam 25. Then the drive stops. A pulse is now supplied to the pivoting member 30 so that its piston rod is extended and swings the beam 29 around the pivot axis 28. After having performed a pivoting motion through 90° the rear side 29' of the beam 29 strikes the stop screw 32 so that the pivoting motion is terminated. On further extension of the piston rod the carriage 27 is shifted in the direction of the beam 25 so that the beam 29 is shifted as well. In this respect the motion of the beam 29 is directed to be perpendicular with the orientation of the beam 25. The clamping member 40 then moves towards the beam gripping the bundling material. At this time the knife 41 has not yet performed a cut and it is only on further motion and when the bundling material is sufficiently firmly gripped that the knife 41 moves past the clamping member 40 so that its cutting edge enters the groove 42 therefor in the beam 25 and neatly cuts the bundling material. The end section 15'' so produced running to the material 43 to be bundled is now blown by means of a further air nozzle 50 towards the material to be bundled 43 so that it abuts the turns of bundling material, this being aided by the tackiness of the bundling material. There is now a new end section 15' leading to the supply roll, which is however held by the gripping device. Simultaneously with this operation the carrier 21 is moved by the cylinder actuator 23 into the initial position as shown in FIG. 2, something that is also shown in FIG. 13. The next bundling operation is now able to be performed.

From the foregoing disclosure of the general principles of the present invention and the preceding detailed description of a preferred embodiment, those skilled in the art will comprehend various modifications to which the invention is susceptible. Therefore, we intend to be limited only by the scope of the following claims.

Having described our invention, we claim:

1. A bundling machine comprising:

a supply roll for bundling material;

a driven ring, said supply roll be carried by said driven ring;

a gripper device for grabbing and separating the bundling material, said gripper device comprising a moveable support;

a carriage, said carriage being mounted upon said moveable support for movement transverse to the direction of motion of said support;

first and second beams for clamping and cutting said bundling material;

means for pivoting said first beam relative to said second beam, said second beam being rigidly mounted upon said support adjacent to one end thereof;

means guiding said carriage for movement along said support;

spring means urging said carriage in a direction away from said second beam; said first beam being mounted upon said carriage;

stop means carried by said support for limiting pivotal movement of said first beam to a position in which said first beam is parallel to said second beam.

2. The bundling machine of claim 1 further comprising a spring loaded member and a cutting blade carried by said first beam, said first beam being pivoted to an open position in which said first beam is remote from said second beam, said spring loaded member protruding beyond said cutting blade when said first beam is in said open position.

3. The bundling machine of claim 1 further comprising an arm carried by said support, said means for pivoting said first beam comprising a piston and cylinder secured to said first beam and to said arm.

4. The bundling machine of claim 1 further comprising means for shifting onto the goods being bundled, the end section of said bundling material obtained after cut-off.

5. The bundling machine of claim 4 in which said last named means are pneumatic means.

6. The bundling machine of claim 4 in which said last named means comprise an air nozzle.

7. The bundling machine of claim 1 in which said bundling material is a relatively thin plastic foil.

* * * * *